United States Patent [19]

Vickers

[11] Patent Number: 4,673,784

[45] Date of Patent: Jun. 16, 1987

[54] VALVE SEAT INDUCTOR AND METHOD OF USING SAME

[75] Inventor: Robert V. Vickers, Chagrin Falls, Ohio

[73] Assignee: Tocco, Inc., Boaz, Ala.

[21] Appl. No.: 921,906

[22] Filed: Oct. 27, 1986

Related U.S. Application Data

[63] Continuation of Ser. No. 712,744, Mar. 18, 1985, abandoned.

[51] Int. Cl.[4] ..... H05B 6/10

[52] U.S. Cl. ..... 219/10.57; 219/10.43; 219/10.79; 266/129; 148/145

[58] Field of Search ..... 219/10.79, 10.57, 10.43, 219/10.41, 10.73, 10.71, 10.49 R; 266/129; 148/145, 150, 152

[56] References Cited

U.S. PATENT DOCUMENTS

| | | | |
|---|---|---|---|
| Re. 29,046 | 11/1976 | Delpaggio | 219/10.57 |
| 3,188,440 | 6/1965 | Wokas | 219/10.79 |
| 3,236,993 | 2/1966 | Jones | 219/10.79 X |
| 3,331,938 | 7/1967 | McDanels | 219/10.79 |
| 3,737,612 | 6/1973 | Pfaffmann et al. | 219/10.79 |
| 3,743,809 | 7/1973 | Delpaggio | 219/10.57 |
| 3,761,669 | 9/1973 | Delpaggio | 219/10.57 |
| 3,777,096 | 12/1973 | Delpaggio | 219/10.57 |
| 3,789,180 | 1/1974 | Cachat | 219/10.57 |
| 3,798,403 | 3/1974 | Mitchell et al. | 219/10.73 X |
| 3,837,934 | 9/1974 | Pfaffmann | 148/146 |
| 4,163,884 | 8/1979 | Kobetsky | 219/10.79 X |
| 4,266,109 | 5/1981 | Ciolkevich | 219/10.57 |
| 4,438,310 | 3/1984 | Cachat | 219/10.57 X |

*Primary Examiner*—Philip H. Leung

*Attorney, Agent, or Firm*—Body, Vickers & Daniels

[57] ABSTRACT

An inductor for inductively heating the valve seat of an engine component includes non-magnetic spacer pads on the inductor coil which engage the valve seat surface to establish the inductive coupling gap, and a centering nose which enters the valve stem bore and coacts with a universal coupling between the inductor and the inductor frame to provide concentricity between the valve seat and the core and to accommodate angular variations between the valve seat and the inductor frame.

16 Claims, 8 Drawing Figures

VALVE SEAT INDUCTOR AND METHOD OF USING SAME

This is a continuation of Ser. No. 712,744, filed Mar. 18, 1985, now abandoned.

The present invention relates to the art of valve seat heat treating, and in particular, to a valve seat inductor and method of using the inductor for inductively heating the valve seats of an engine component, such as an engine head.

BACKGROUND

The invention is particularly applicable for inductively heating exhaust valve seats or valve seat inserts of internal combustion engines and will be described with reference thereto; however, the invention, in its broader application, may be used in other heat treating applications wherein accurate positioning of an inductor coil is required to assure uniform heating of the surface to be treated, notwithstanding manufacturing variations in the location of the surface and misalignment in the presentation of the inductor coil to the surface to be heated.

The conical valve seats for engine heads are commonly quench hardened to provide extended wear characteristics at the poppet valve-valve seat interface. Inductive heating of the interface has become widely accepted in achieving this objective. For satisfactory heating and subsequent hardening, the inductor coil must be accurately located adjacent the seat, energized by a high frequency current to raise the surface to the elevated heat treating temperature and thereafter rapidly cooled or quenched. Various parameters must be controlled to achieve the uniformity. First, the inductor must be formed complementary to and accurately located with respect to the valve seat surface to insure a uniform width inductive airgap which will result in a uniform magnetic coupling with the coil and, consequently, uniform heating. It is also necessary to attain such relationships in mass production for economical manufacture of motor vehicle engines. This accuracy is difficult to attain unless the inductor positioning apparatus can account and compensate for manufacturing variations in the radial and axial location of the valve seat together with the variations in orientations of the valve seat relative to the heating apparatus as the components traverse past the heating station on a conveyor line. Inasmuch as the apparatus is generally fixedly located with respect to the conveyor line, its operation is mechanically constrained by the apparatus. Each engine component is mounted on the suitable fixture carried by the line. Thus, variations between the fixture and the component, the fixture and the line, and line orientation on a component to component basis with respect to the apparatus, can result in cumulative angularity variances. This need for positioning accuracy has resulted in various approaches being taken with regard to the positioning of the inductor. For instance, U.S. Pat. No. Re. 29,046 illustrates a heat treating apparatus which allows individual inductor assemblies to radially float with respect to the valve seat as they are mechanically axially advanced toward the valve seat area. This radial float is accomplished by inductor assemblies which carry a centering nose which enters the valve stem bore accurately coaxially formed with the valve seat. The ability to move in a radial plane or a plane transverse to the axis of the inductor coil allows the inductor to be mechanically positioned as the inductor nears the interface. This is highly effective in accomodating manufacturing variances in the spacial location of the valve seat. Such approach is ideally suited for the situation where the mechanical axis of the coil is parallel to the axis of the valve seat. In other words, the ability of the inductor to float in a plane perpendicular to both axes will result in self-centering of the coil with respect thereto. Other approaches for achieving this radial alignment feature are illustrated in U.S. Pat. Nos. 4,266,109; 3,837,934; 3,777,096; 3,761,669; 3,743,809 and 3,737,612. Having achieved the concentric coaxial alignment between the valve seat and the inductor coil as prescribed by the centering action of the nose, it is also necessary to accurately establish the axial location of the inductor with respect to the valve seat. The effective depth of such conical surfaces can vary from valve to valve and engine to engine. This axial positioning must be attained to establish the required inductive air gap, generally in the order of 0.030 to 0.050 inches. In addition to creating a uniform inductive coupling and thereby uniform heating, the position also interrelates with the power control system to insure that the required controlled temperatures are attained, and that, with regard to the simultaneous heating of multiple valve seats, an inductive current balance is provided among the various inductors.

One successful approach, as illustrated in the aforementioned U.S. Pat. No. Re.29,046, has been to mount a plurality of inductor assemblies on a common frame to move the inductors as a bank toward the valve seat. The radial float capability allows the individual inductors to seat with respect to each seat. However, inasmuch as the depth of the valve seat may vary from seat to seat, the individual inductor assemblies are spring biased and all are allowed to physically engage the valve seat against a spring biasing. After seating of all the inductors, the inductors are individually locked at the frame and the frame withdrawn to prescribe the predetermined axial distance corresponding to the desired inductive gap. This repetitively provides accurate inductive positioning for axial and radial variations in a location of the valve seat surface.

Notwithstanding the accomodation of radial and axial variations in valve seat location, the apparatus does not inherently compensate for non-parallelism between the axis mechanically prescribed by the apparatus and the axis of the valve seat as presented relative to the machine at the heat treating station. While efforts have been made to limit such angularity by careful control of the manufacturing and production process, it has heretofore not been entirely possible to eliminate this misalignment. While this angularity can be partially compensated by part deflection or inherent freedom of movement of the assembly, this puts additional loading on the parts and may cause premature failure of the components. To a large extent, this angularity is compensated by freedom of movement between the centering nose and the valve stem bore. Typically, the centering nose penetrates the valve stem bore a rather short distance, generally in the order of $\frac{1}{2}$ to $\frac{5}{8}$ inch and has a clearance fit with respect to the valve bore surface. This will allow a certain misalignment or cocking to be tolerated without loading the assembly. However, these clearance relationships may be established at a sacrifice in concentricity between the parts. Further, any tolerated angularity, of necessity, results in a non-uniformity of the coupling gap as the inductor coil is retracted from physical engagement to the heating position. Thus, while substantially improving the accuracy with which valve seat surfaces may be heated, there is nonetheless a need for a device which will compensate for the non-parallelism between the valve seat axis and the inductor coil axis.

BRIEF SUMMARY OF THE INVENTION

The present invention provides a valve seat inductor and method of using the same which in addition to axially and radially accurately positioning the inductor coil with respect to the valve seat, also compensates for non-parallelism between the apparatus prescribed axis of the inductor coil and the conveyor and component dictated orientation of the valve seat axis.

This is achieved by permitting the inductor coil and the valve seat to mechanically coact to establish concentricity and axial spacing while accomodating in a non-deflecting manner, a reorientation between the inductor coil and the frame mounted inductor holding and transfer assemblies. This is accomplished in three aspects. First, the inductor coil is allowed to float in a radial plane transverse to the apparatus axis thereby allowing the inductor coil to handle radial variations in the aforementioned manner. The inductor coil is also allowed to universally float cojointly with the radial movement. This allows the inductor coil to orient itself with a valve seat axis without imposing a loading on the inductor support assembly. Second, the centering nose has an extended length and a closer tolerance with respect to the valve stem bore. Inasmuch as the ability of the inductor coil to bear an angularity is a function of these parameters, the increased length and closer tolerance results in a mechanical centering of the coil solely with reference to the component orientations. Third, the axial gap between the surfaces after the coaxial positioning is mechanically prescribed by non-magnetic spacing members carried on the surface of the inductor coil and having a thickness corresponding to the predetermined inductive air gap. Such inserts are passive during the inductive heating cycle and accordingly do not interfere with the uniformity to which the temperature of the surface may be raised. Furthermore, the spacers are in an orientation and with an area to affirmatively orient the inductor without imposing excessive loads in either the inductor coil or the valve seat surface. By physically attaching the spacer pads circumferentially on the coil as opposed to for instance a feeler gage, a separate positioning apparatus or manual operation is not required. Further, removal of the spacer prior to heating is not required, thus eliminating potential abrasive wear to the coil, and any cocking tendency of the coil relative to the seat during the positioning. With such an arrangement, it is possible to retain the aforementioned benefits of the prior art devices while achieving control over the remaining contributors to non-uniformity in positioning.

Accordingly, a primary object of the present invention is the provision of an inductor which compensates for radial, axial and angular variation between the inductor coil and the surface to be heated.

Another object of the present invention is the provision of an inductor coil which achieves mechanically imposed concentricity between the inductor and the valve seat, notwithstanding angularity variations between the inductor apparatus and the conveyor presented component.

A further object of the invention is the provision of an inductor coil which is mechanically axially spaced with respect to the valve seat of an engine component by non-magnetic, heat resistant spacer pads.

Still another object of the present invention is the provision of an apparatus and method for establishing accurate concentric positioning of an inductor coil at a predetermined spacing from the valve seat surface by transferring inductor alignment from the inductor apparatus to the engine component as the inductor is moved into physical contact with the valve seat and accurately spaced thereat by non-magnetic spacing members.

BRIEF DESCRIPTION OF THE DRAWINGS

These and other objects and advantages will become apparent from the following description taken in conjunction with the accompanying drawings in which.

DETAILED DESCRIPTION OF THE PREFERRED EMBODIMENT

Figure 1:
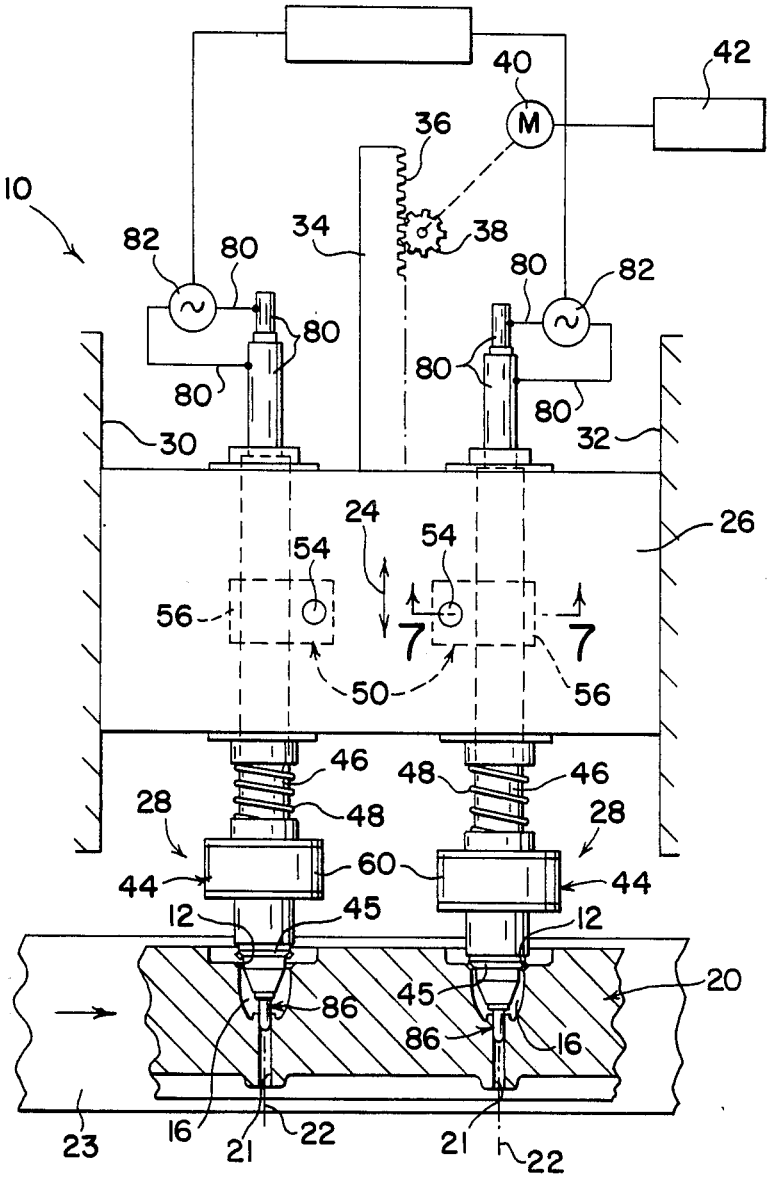
FIG. 1 is a side elevational view showing, schematically, the induction heating apparatus in accordance with the present invention with one inductor being shown in operative position with respect to the valve seat of an engine component and the other inductor coil being shown approaching the operative position.

Referring now to the drawings wherein the showings are for the purpose of illustrating the preferred embodiment of the invention only, and not for the purpose of limiting same, FIG. 1 shows an induction heating apparatus 10 for inductively heating two adjacent conical valve seats 12 located within the exhaust ports 16 of an engine head 20. The exhaust ports include valve stem bores 21 formed coaxially with the valve seats and which telescopically support the valve stems of conventional poppet valves in assembly for reciprical movement along an axis 22. In accordance with the invention, a number of such valve seats are simultaneously heated by the apparatus 10. However, for purposes of illustrating the present invention, only two such valve seats are shown. The induction heating apparatus with the exceptions hereinafter noted, preferably takes the form disclosed in U.S. Pat. No. Re. 29,046 which is hereby incorporated by reference. Such apparatus is shown schematically herein. The apparatus 10 is fixedly mounted adjacent a conveyor line 23 which carries the engine heads 20 on suitable fixtures, not shown. The conveyor line 23 operates in a conventional manner to sequentially shuttle the engine head into alignment with induction heating apparatus 10, with the fixtures presenting the engine head in a predetermined orientation. Through a rigid manufacturing control, the fixtures are operative to accurately orient the valve head with respect to the controlled movement of the induction heating apparatus 10. However, in actual practice, variations occur during operation of the conveyor line, positioning of the head relative to the fixture, which together with other potentially cumulative variations result in a complex angularity between the direction of the apparatus axis 24 and the valve stem axis 22.

The apparatus 10 generally comprises a support frame 26 which carries two identical inductor assemblies 28. The support frame 26 is guided for transverse movement along the axis 24 by guides 30 and 32. Movement of the frame in a direction toward and away from the engine head 20 is effected by a transfer mechanism comprising a transfer bar 34 connected to the frame 26 and having a rack 36 at the outer end thereof engaged by a pinion 38 drivingly connected to a motor 40 under the operation of control system 42. The control system 42 is sequenced with the operation of the conveyor line 23 to advance the frame 26 and the inductor assemblies 28 toward the head 20 when the latter is accurately positioned adjacent the apparatus 10 and to initiate a heating cycle and to retract the frame 26 and the inductor assemblies 26 from the head 20 upon completion thereof.

Figure 7:
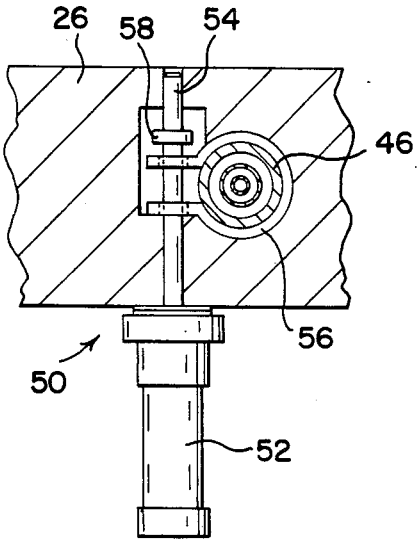
FIG. 7 is an enlarged cross sectional view taken along line 7—7 in FIG. 1; and, FIG. 8 is an enlarged, partially sectioned view taken along line 8—8 in FIG. 3.

Each inductor assembly 28 includes an inductor head 44 frontally carrying an inductor coil 45 and a guide sleeve 46 connected to the outer portion of the head 44 and reciprocably disposed in a bore in the frame 26. A helical spring 48 compressively retained between the frame 26 and the head 44, concentrically with the sleeve 46, serves to resiliently bias the head 44 to an extended position. The position of the individual sleeves 46 may be locked with respect to the frame 26 by pneumatic locking assemblies 50. As shown in FIG. 7, the locking assembly 50 comprises a pneumatic or hydraulic actuator 52 mounted on the frame 26 and having an output shaft 54 which extends through a frame bore and through openings in the terminal ends of a clamp ring 56 which surrounds an intermediate portion of the sleeve 46 interior of the frame 26. The output shaft 54 includes a clamping collar 58 which engages one of the terminal ends of the clamp ring 56. In the extended position of the actuator 52 as actuated by conventional fluid lines and control systems, not shown, the collar 58 is spaced from the clamp ring 56 and a diametral clearance is established between the sleeve 46 and inner surface of the clamp ring 56 which allows the sleeve 46 to freely reciprocate relative to the frame 26 against the biasing of the spring 48. In the retracted position, the collar 58 engages the end of the clamp ring 56 to decrease the effective diameter of the clamp ring 56 and thereby frictionally engage and clamp the sleeve 46 against movement with respect to the frame 26. The operation of the locking assembly 50 is sequenced as hereinafter described.

Figure 2:
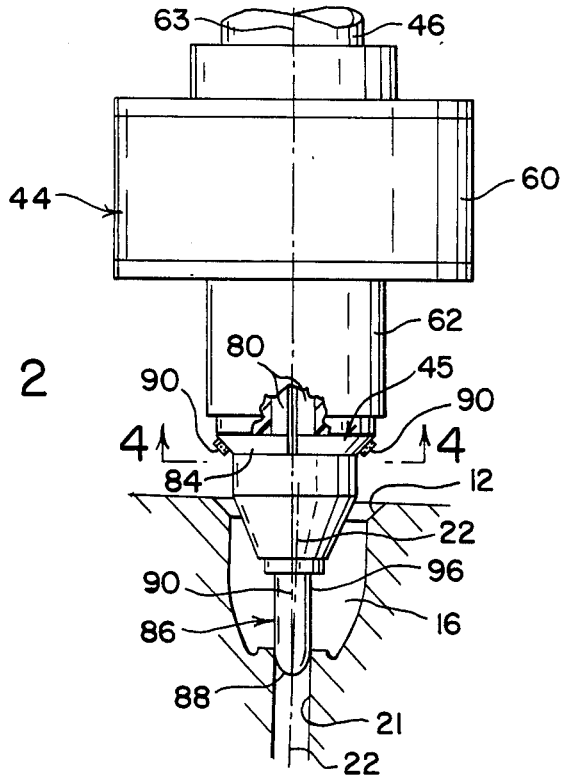
FIG. 2 is an enlarged fragmentary cross sectional view showing preliminary centering of the inductor coil with the angularity between the inductor coil and the valve seat being greatly exaggerated.
Figure 3:
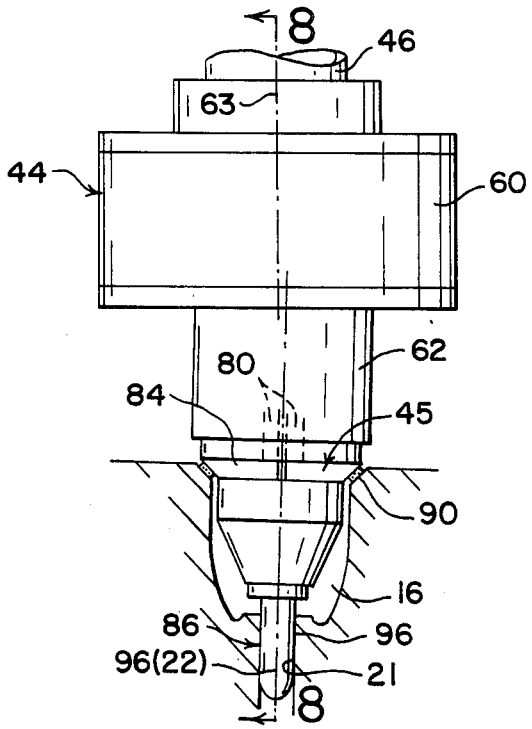
FIG. 3 is a view similar to FIG. 2 showing the inductor fully seated and centered with respect to the valve seat.
Figure 8:
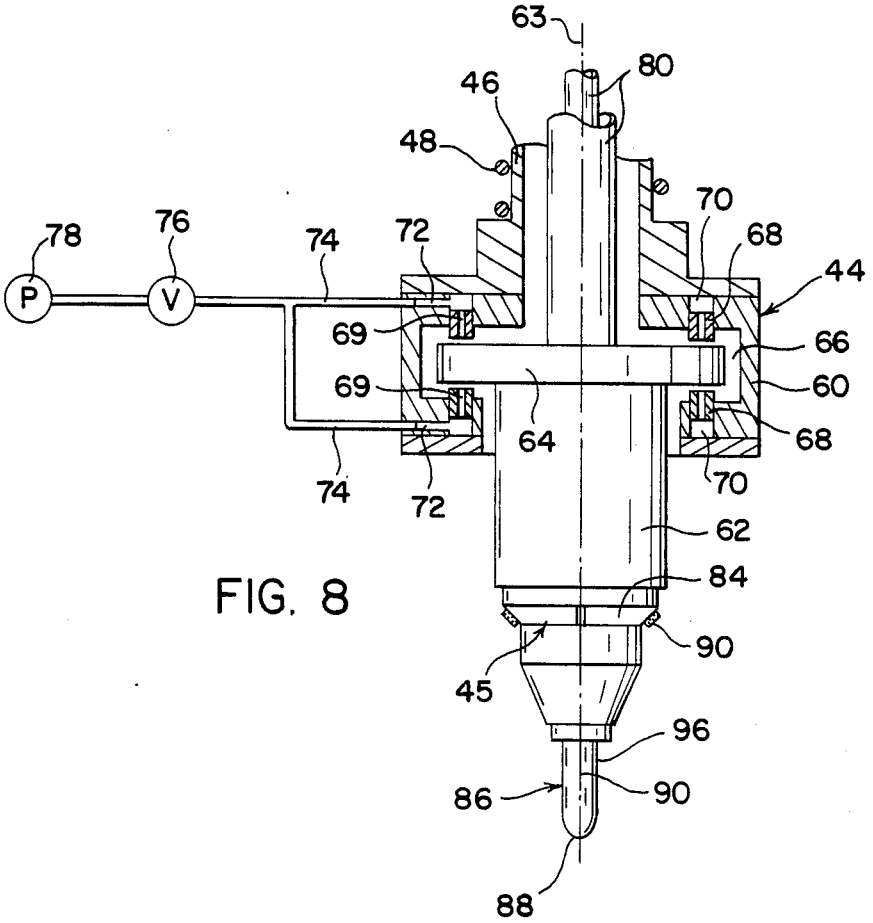

Referring additionally to FIGS. 2 and 3, the inductor head 44 includes a housing 60 fixedly connected to the inner end of the sleeve 46 which supports an inductor carrier 62 which is free to move in a radial plane transverse to the axis 63 of the sleeve 46 and parallel to the apparatus axis 24 and also assume angularity with respect thereto. This translation in the present embodiment is provided by mounting the carrier 62 with respect to the housing 60 through an air bearing assembly. As shown in FIG. 8, the carrier includes an annular flange 64 which is disposed within a frontally opening cylindrical chamber 66 interior of the housing 60. Distributor rings 68 are retained in channels in the housing adjacent the chamber 66 and have axial outlet ports 69 which communicate with a circumferential plenum 70 connected by passages 72 to air lines 74 which are fluidly connected to a control valve 76 connected to an air supply 78. In a conventional manner, the air bearing assembly is effective to fluidly support the flange 64 for guided movement in a plane transverse to the sleeve axis 63. However, the clearances between the flange 64 and the distributor rings 68 are sufficient to allow the flange 66 and thereby the carrier 44 to bear an angularity within the chamber 66 with respect to the axis 63 as required to effect full seating of the inductor assembly, while accomodating the required radial movement and without imposing any significant direct loading between the head oriented carrier and the apparatus oriented housing. It is apparent that these capabilities may also be provided by other arrangements. For instance, the radial floating head of the aforementioned U.S. Pat. No. Re. 29,046 may be utilized to permit the carrier to radially float with respect to the housing. The permissive deflection of the carrier with respect to the housing may be provided by increasing the play in the guide bearings, providing a universal connection between the carrier and the radially translating flange, providing for resilient mounting of the carrier with respect to a radially floating member, or otherlike arrangements which are angularly deflectable and radially translatable.

Figure 5:
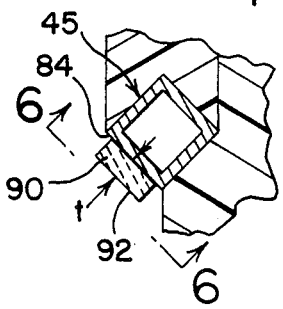
FIG. 5 is an enlarged cross sectional view showing the spacer pads on the inductor coil.

The carrier 62 supports the inductor coil 45, formed in a conventional manner of rectangular copper tubing, in a circumferential channel formed in a conical forward portion thereof. The inductor coil 45 includes rearwardly projecting leads 80 retained in axial slots on the carrier 62 which project appropriately thereto and are electrically connected to a power supply 82 in a conventional manner and as more specifically described in the aforementioned U.S. Pat. No. Re. 29,046. The inductor coil 45, as shown in FIG. 5, has an outer conical surface 84 formed at the complementary angle to the conical angle of the valve seat 12. The surface 84 has a mean diameter substantially the same as the mean diameter of the valve seat 12 with the surface being coextensive or overlapping with respect thereto when positioned in operative relation. The carrier includes an elongated cylindrical centering nose 86 having a rounded tip 88. The axis 90 of the nose 86 is coincident with the axis of the conical surface 84 and by means of the air bearing assembly is normally maintained parallel to the axis 63 of the sleeve 46 and the axis 24 of the apparatus.

Figure 4:
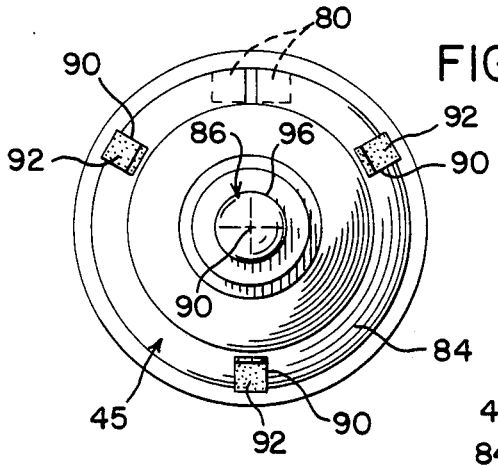
FIG. 4 is an end view taken along line 4—4 of FIG. 2 showing the orientation of the spacer pads on the inductor coil.
Figure 6:
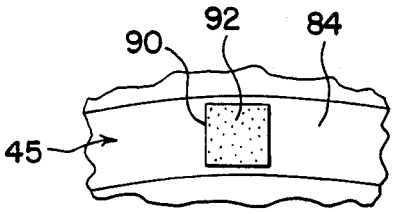
FIG. 6 is a view taken along line 6—6 in FIG. 5.

A plurality of non-magnetic ceramic spacer pads 90 are fixedly attached to the conical surface 84 of the coil 45 in a circumferential array as shown in FIG. 4. Referring additionally to FIGS. 5 and 6, the pads 90 have a thickness t corresponding to magnetic coupling gaps required for optimum magnetic coupling with the valve seat 12 and inductive heating thereof. The outer surface 92 of the pads 90 are accurately formed to lie on a conical surface of revolution parallel to the surface 84 and complementary to the valve seat surface. The pads have a substantial contact area with a valve seat 12 so as to distribute any inductor loading in a manner which will not cause deformation of the valve seat surface. The orientation of the pads 90 and the number is sufficient to assure at least three point seating contact with the valve seat to assure affirmative positioning. However, a greater number may be used and if desired, the spacer pads may be in the form of a continuous ring or arcuate segments inasmuch as the ceramic spacer pads are passive during the inductive heating cycle. The nose 86 has a cylindrical body 96 of substantial length, around 1" or more. The diameter of the body 96 provides a close sliding fit with the valve stem bore 21 at the engine port 14. Inherently, in the manufacturing process, the valve stem bore 21 is formed accurately concentrically with respect to the valve seat 12, whether the valve seat 12 is formed directly on the engine head or on an insert retained thereat in a conventional manner. The extended length and close sliding fit of the nose 86 with respect to the bore 21 insures that the carrier 44 and accordingly the coil 45 and the spacer pads 90 will not be angularly oriented with respect to the valve seat surface, but will have sufficient freedom of movement to permit the pads to affirmatively seat against the valve seat and be coaxially positioned with respect thereto.

OPERATION OF THE PREFERRED EMBODIMENT

In illustrative operation, as shown in FIG. 1, the engine component may be oriented with respect to the conveyor line 23 so as to establish an angularity with respect to the valve stem axis 22 and the apparatus axis 24. In other words, the angularity is presented between the machine prescribed axis of motion and the conveyor line prescribed valve seat orientation. As the engine head 20 is sequenced to the heat treating station, the control system 42 actuates the motor 40 thereby rotating the pinion 38 and translating the rack 36 moving frame 26 toward the head in an advancing mode. This carries the inductor assemblies 28 concurrently forwardly toward the valve seat. As the nose 86 preliminarily enters the valve stem bore 21, the air bearing assembly accomodates radial translation of the carrier 62 in a plane transverse to the machine axis 24. As the nose further penetrates the bore 21 during the advancing movement, any angularity will be accomodated by the air bearing to transfer coil positioning from the machine to the component. This concentricity will be increasingly prescribed as the nose 86 enters the bore 21 and finally prescribed as the centering nose 86 is fully received within the bore 21 and the spacer pads 90 physically contact the associated valve seat 12. This will then accomodate for any variation in radial or angular orientation of the valve seat with respect to the machine axis. However, the axial depth of the valve seat surface with respect to the other valve seats may nonetheless vary. Accordingly, the frame 26 is further advanced until all spacer pads are engaged with the associated valve seats. During this further advancing movement, the spring 48 accomodates sequential seating without the substantial increase in the seating engagement force. When all pads 90 are engaged, the locking assemblies 50 may be actuated to fixedly lock the sleeves 46 with respect to the frame 26. Alternatively, the locking assemblies 50 may be eliminated or may be operative only after completion of the inductive heating cycle to simultaneously retract the bank of inductor assemblies 28 from the valve seats 12. At the inductive heating position, in addition to the concentricity of orientation, the spacing pads 90 prescribe the optimum coupling between the coil and the valve seat 12. Thus, upon energization of the power supply 82, the inductor coil 45 will be effective to inductively heat the valve seat and raise the temperature thereof to the elevated heat treating temperature required for the valve seat material. Thereafter, the power supply is deenergized and the valve seat quenched. This may be accomplished either by mass quenching resulting from the heat sink effect of the engine head mass or may be provided in a conventional fashion by quenching jets carried by the carrier and connected to an appropriate coolant supply, also as more fully described in the aforementioned U.S. Pat. No. Re. 29,046. The direct quenching will require a retraction of the inductor assembly to locate the quenching jets adjacent the heated valve seat as provided as required by the control system 42. Following completion of the heat treating cycle, the frame 26 is fully retracted by motor 40 to the original position and the conveyor line 23 indexed to present the next head at the heat treating and the aforementioned cycle repeated.

It is claimed:

1. An apparatus for inductively heating the frustoconical valve seat surface of a valve port or an engine component having a valve stem bore coaxially disposed with respect to the valve seat surface, said apparatus comprising:

an inductor coil having a conical surface complementary to the valve seat surface;

frame means for advancing said coil toward the valve seat with the axis of the coil surface being substantially parallel to the axis of the valve seat;

bearing means operative between the inductor coil and the frame means accommodating radial and angular movement of said inductor coil to an orientation wherein the axes of the conical surfaces are coincident;

an elongated nose member having a cylindrical surface coaxial with the conical surface of the valve seat, said cylindrical surface having a close telescopic sliding fit with and entering the bore of said port upon advancing of said frame means and when received therewithin establishing coincidence of the axes as accommodated by said bearing means; and, non-magnetic insulating spacer means attached to said conical surface of said coil having outer reference surfaces thereon lying on a conical surface spaced from the inductor coil a predetermined distance thereby prescribing concentricity and axial spacing between the conical surfaces of the seat and said coil.

2. The apparatus as recited in claim 1 wherein said spacer means are formed of a ceramic material.

3. The apparatus as recited in claim 1 wherein said spacer means are in the form of conical segments uniformly circumferentially spaced about the conical surface of said inductor coil.

4. The apparatus as recited in claim 1 wherein said bearing means provide free translation of said coil in a radial plane transverse to the axis of said frame means and limited angularity with respect thereto.

5. An apparatus as defined in claim 1, wherein said spacer means have a predetermined circumferential spacing about said coil surface.

6. An apparatus as defined in claim 1, wherein at least one of said spacer means is formed as an arcuate conical segment having a predetermined circumferential location and arcuate extent at said conical surface.

7. An inductor for inductively heating a frustoconical work surface of an engine component and for an induction heating apparatus including a frame movable along a first axis, said inductor comprising: an inductor body having a second axis; an inductor coil of generally rectangular hollow cross section, said coil having an outer frustoconical surface coaxial with said second axis; a plurality of discrete, heat resistant, electrically non-conductive spacer pads attached to said outer frustoconical surface of said coil, said spacer pads having outer reference surfaces commonly lying in a unique conical surface of the same conical angle as said frustoconical surface of said coil and spaced a predetermined axial distance therefrom, said reference surfaces providing cam surfaces for concentric alignment of said coil with said frustoconical work surface; and said spacer pads providing a predetermined axial inductive coupling distance between said coil and said frustoconical work surface.

8. The inductor as recited in claim 7 including a housing having a first part connected to the frame and a second part connected to said inductor body, and bearing means between said first part and said second part accommodating radial movement in a plane transverse to said second axis and limited angular movement of the said first part with respect to said second part.

9. An apparatus as defined in claim 7, wherein said spacer pads have a predetermined circumferential spacing about said coil surface.

10. An apparatus as defined in claim 7, wherein at least one of said spacer pads is formed as an arcuate conical segment having a predetermined circumferential location and arcuate extent at said conical surface.

11. A method of locating a conical inductor coil concentrically with respect to a conical valve seat of an engine component and at a predetermined axial spacing therefrom for inductive heating of the valve seat comprising the steps of:

a. advancing the inductor coil toward the valve seat;
b. radially shifting and angularly deflecting the coil with respect to the valve seat during said advancing by mechanical coaction therebetween until the conical surfaces of the valve seat and the coil are concentrically disposed along a common axis;
c. providing non-magnetic spacers on the conical surface of the coil having reference surfaces lying on a conical surface coaxial with the conical surface of the coil and axially spaced therefrom equal to said predetermined axial spacing;
d. seating said reference surfaces against the conical valve seat during said advancing after the coil and the valve seat are concentrically disposed along said common axis;
e. terminating said advancing after said seating of said reference surfaces;
f. energizing said inductor coil and heating said valve seat to a predetermined elevated temperature; and,
g. retracting said coil from said valve seat.

12. A method as defined in claim 11, further comprising the step of providing said spacers in a predetermined circumferentially spaced relationship.

13. A method as defined in claim 11, further comprising the step of providing at least one of said spacers in the form of an arcuate conical segment having a predetermined circumferential location and arcuate extent about said coil surface.

14. An apparatus for inductively heating the frustoconical valve seat surface of a valve port of an engine component having a valve stem bore coaxially disposed with respect to the valve seat surface, said apparatus comprising:

an inductor coil having a conical surface complementary to the valve seat surface;
frame means for advancing said coil toward the valve seat with the axis of the coil surface being substantially parallel to the axis of the valve seat;
bearing means operative between said inductor coil and said frame means accommodating radial and angular movement of said inductor coil to an orientation wherein the axes of said conical surfaces are coincident;
means carried with said inductor coil cooperating with the bore of said port upon advancing of said frame means for establishing coincidence of said axes as accommodated by said bearing means; and,
electrically passive spacer means on said conical surface of said coil directly engaging said frustoconical valve seat surface for prescribing concentricity and axial spacing between said coil and said valve seat surface.

15. A method of inductively heating a conical valve seat comprising the steps of:

a. providing an inductor coil having a conical surface complementary to the valve seat;
b. providing a plurality of discrete, electrically non-conductive heat resistant spacer pads on said conical surface of the coil, said pads having frontal surfaces commonly lying on a unique conical surface uniformly spaced a predetermined distance from said conical surface of said coil;
c. seating said frontal surfaces of said spacer pads against the conical valve seat thereby providing a predetermined coupling between said inductor coil and said valve seat, said coupling corresponding to the thickness of said spacer pads; and,
d. energizing said inductor coil to heat said valve seat to a predetermined elevated temperature.

16. An inductor for inductively heating a conical workpiece surface and comprising: an inductor body having an axis; an inductor coil of generally rectangular hollow cross section, said coil having an outer frustoconical surface coaxial with said axis and complementary to said conical workpiece surface a plurality of heat resistant, electrically non-conductive spacer pads attached to said outer frustoconical surface of said coil, said spacer pads each having an outer reference surface receivable on said conical workpiece surface and lying in a unique conical surface of the same conical angle as said frustoconical surface of said coil and spaced a predetermined axial distance therefrom, said reference surfaces having predetermined circumferential locations and arcuate extent with respect to said conical coil surface; and, said spacer pads providing an induction heating coupling distance between said coil and said workpiece surface corresponding to said predetermined axial distance when said reference surface is received on said conical workpiece surface.

* * * * *